United States Patent [19].

Benedyk et al.

[11] Patent Number: 5,046,546

[45] Date of Patent: Sep. 10, 1991

[54] SCREEN ENCLOSURE APPARATUS

[75] Inventors: Joseph C. Benedyk, Lake Zurich; Ronald J. Basar, Geneva, both of Ill.

[73] Assignee: Alumax Extrusions, Inc., St. Charles, Ill.

[21] Appl. No.: 577,260

[22] Filed: Sep. 4, 1990

[51] Int. Cl.[5] ..... E06B 9/00

[52] U.S. Cl. ..... 160/371; 160/392; 160/395; 24/462; 24/704.1

[58] Field of Search ..... 160/371, 391, 392, 395, 160/369; 24/462, 460, 704.1

[56] References Cited

U.S. PATENT DOCUMENTS

| | | | |
|---|---|---|---|
| 1,959,136 | 5/1934 | Miller | 156/39 |
| 2,541,971 | 2/1951 | Thies | 160/369 |
| 2,759,538 | 8/1956 | Long | 160/379 |
| 2,837,153 | 6/1958 | Brown et al. | 160/371 |
| 3,255,810 | 6/1966 | Rowbottam | 160/371 X |
| 3,273,633 | 9/1966 | Seidmon et al. | 160/395 X |
| 3,374,597 | 3/1968 | Whitener | 160/391 X |
| 3,552,476 | 1/1971 | Le Tarte | 160/392 X |
| 3,720,256 | 3/1973 | Fralick et al. | 160/392 |
| 3,879,894 | 4/1975 | Anderson | 160/395 X |
| 3,895,468 | 7/1975 | Bernstein | 160/395 X |
| 3,960,197 | 6/1976 | Daniels | 160/371 |
| 3,991,806 | 11/1976 | Abell | 160/392 X |
| 4,261,144 | 4/1981 | Rizzo | 160/392 X |
| 4,913,212 | 4/1990 | Clavier | 160/371 X |

*Primary Examiner*—David M. Purol

*Attorney, Agent, or Firm*—Dick and Harris

[57] ABSTRACT

A screen enclosure apparatus, for use in screened windows, porches, doors and other screened-in builiding structures, capable of controllably breaking away upon excessive impact of resultant wind pressures on the frame of the apparatus. A frame structure having a channel running along the frame's length, serves to releasably or frangibly receive spline material which displaces or fractures at a predetermined resultant pressure. The spline serves to releasably secure a screen sheet, within the channel of the frame itself, so as to preclude damage which would otherwise occur not only to the screen sheet, but also to the supporting frame structures, when such high wind pressures are exerted thereon—to reduce the structural rigidity requirements for such frames. Venting members are also utilized to minimize contact between the spline and potentially corrosive elements which may be prevalent in the channel of the frame, and are further used to reduce the likelihood of certain kinds of corrosion from actually occurring within the channel, as well as adhesion of the spline to areas of corrosion.

15 Claims, 3 Drawing Sheets

SCREEN ENCLOSURE APPARATUS

BACKGROUND OF THE INVENTION

The present invention relates in general to screened enclosures, and more particularly, to a screen enclosure apparatus for use in association with windows, porches, doors, and sun rooms among other things, and primarily for use in geographical areas prone to high wind and/or hurricane conditions, wherein the apparatus is capable of controlled release of the spline and screen sheet material which are secured to the frames of an associated structure.

For many years, industry has manufactured screen enclosures for use in place of glass window panes, and the like, so as to enable fresh air to enter in and out of a house, porch, shed, sun room or other building structure. Although such enclosures have proven adequate in many situations, few, if any of the prior art enclosures are designed to avoid damage, when excessive wind pressures, such as the high wind pressures prevalent in hurricane prone environments, are exerted upon the outer face of the screen itself. Typically, when such high winds occur, the forces associated therewith exert substantial force on the screen sheets, notwithstanding their porosity, to stretch and/or tear the screens or worse yet, transfer substantial forces from a high strength screen and spline structure that do not yield to the frames between which the screens are suspended.

Inasmuch as many of the screen frames used today are constructed from aluminum, and specifically, extruded aluminum, one of the most contemplated methods for use in designing such frames to meet wind load requirements in high wind prone areas, has been to increase the wall thickness of the aluminum frames themselves. Although such a method has proven successful, in that damage to a reinforced, more costly frame is greatly reduced upon exertion of such high winds, it still fails to alleviate stretching, or other damage which may still result to the screen sheet, or costlier structural distortion to the frame. However, an even greater concern inures to the impact such a product has on the ultimate consumer. Specifically, increasing the wall thickness of the frame requires an increase in structural material, which, thereby, increases the overall cost of the product. Accordingly, this increase in cost is then reflected in the price charged to the contractors, as well as consumers—all of which result in residential, as well as some commercial, building construction being needlessly more expensive than it already is.

Yet additional problems have also presented themselves with the use of prior art screen enclosures. Specifically, prior art "non-pop-out" spline structures, i.e. splines which maintain the screen in place until the spline is manually withdrawn and pulled from position in the frame, and which are currently used in areas such as those prone to high wind conditions, are extremely non-responsive to wind pressure on the screen, and extremely prone to the initiation and proliferation of filiform corrosion (a form of corrosion which occurs in spline groves, or channels, of painted or anodized aluminum extrusions when exposed to salt found in the air near coastal areas). Accordingly, as such corrosion forms, the ability of any spline to actually release from the groove, or channel is severly hindered—due to adhesive fouling from the substantial contact between the spline itself and the corrosive products in the channel.

It is thus an object of the present invention to provide a screen enclosure apparatus which facilitates the passage, or venting, of air between the channel of the frame structure and the spline itself, so as to minimize contact therebetween, as well as to reduce the likelihood of the formation of filiform corrosion within the channel—while giving way, elastically or frangibly, to the exertion of wind pressure against the screen.

It is also an object of the present invention to provide a screen enclosure apparatus which utilizes an extruded aluminum frame having a relatively thinner wall thickness than otherwise required to withstand such wind pressures—thereby decreasing the amount of material necessary to manufacture the frame, and accordingly, keeping the overall material costs of construction to the consumer to a minimum.

It is still further an object of the invention to provide a screen enclosure apparatus which has a displaceable or frangible spline, wherein such displacement or fracture occurs upon exertion of a predetermined amount of wind pressure on the front surface of the screen sheet of the apparatus.

It is also an object of the present invention to provide a screen enclosure apparatus wherein the release of at least a portion of the screen from its frame occurs by deformation or breakage of the spline itself—without reliance upon failure of the actual screen materials which often vary beyond predictability—often only after frame damage has occurred.

It is yet an additional object of the invention to provide a screen enclosure apparatus which facilitates only partial displacement of the spline, and accordingly only partial removal of the screen itself, from the frame, upon exertion of a predetermined amount of wind pressure, so as to enable ease in reinsertion and reuse of an undamaged, screen, frame and spline structure.

These and other objects of the invention will become apparent in light of the present Specification and Drawings.

SUMMARY OF THE INVENTION

The present invention relates to a screen enclosure apparatus which is intended to be used in screen windows, porches, doors and other screenable building structures. The apparatus is capable of controllably breaking away in the presence of high wind and/or hurricane conditions to, in turn, automatically reduce resultant wind pressures on the remaining screen segments, as well as the actual frames of the windows, porches, doors and other structures.

The screen enclosure apparatus comprises one or more frame means. Each of these frame means has a front surface and a back surface which is positioned opposite to the front surface, two oppositely positioned sides, a longitudinal dimension and a transverse dimension. One or more channel means are integrally formed within the frame means and span at least a portion of the longitudinal dimension of the frame means. One or more screen sheet means, each of which have a front surface and a back surface opposite the front surface, a top edge, a bottom edge opposite the top edge, a first side edge and a second side edge opposite the first side edge, are releasably received within a portion of the frame means. Specifically, displaceable spline means are used for securing, and alternatively controllably releasing, at least a portion of the one or more screen sheet means from the channel means. Such controllable release occurs as a result of pressure which is exerted against the screen sheet means by outside wind forces.

The controlled release by the displaceable spline means results upon exertion of a predetermined amount of outside wind force pressure upon the front surface of the one or more screen sheet means. The controlled release of the portion of the displaceable spline means, and in turn, a portion of the one or more screen sheet means, from the channel means of the frame means, permits at least some of the outside wind force pressures to pass freely therethrough. Accordingly, such high wind pressures, are precluded from increasing to the point of damaging both the screen sheet means, and the frame structures supporting them, as a result of the reduced screen resistance which would otherwise occur if screen sheet means had not been released from the frame means.

In a preferred embodiment of the invention, the displaceable spline means is constructed from a substantially elastomeric material for facilitating the controlled deformation and/or "pop-out" release of at least a portion of the displaceable spline means upon the exertion of outside wind force pressure upon the front surface of the one or more screen sheet means. Such deformation facilitates the release of at least a portion of the displaceable spline means, and accordingly at least a portion of the one or more screen sheet means emanating from the channel means of the frame means. In addition, in this elastomeric embodiment, after the displaceable spline means, and accordingly, the screen sheet means, is released from the channel means, each may be reinserted back into the channel means, if controlled release occurred early enough to preclude damage to each. Accordingly, such a design contemplates the potential re-use of the displaceable spline means, as well as the screen sheet means.

In an alternative preferred embodiment of the invention, the displaceable spline means is constructed from a substantially non-elastomeric frangible material for facilitating the controlled frangible breakage of at least a portion of the displaceable spline means upon exertion of outside wind force pressure upon the front surface of the one or more screen sheet means. When the spline means severs, that severed portion of the spline which is securing the screen sheet means, is released from or reduced within the channel means, and accordingly the portion of the screen sheet means which was previously retained by that portion of the spline means, is also released. Through conventional material selections, a more brittle version of spline material may be selected instead of the elastomeric embodiment.

In either embodiment of the invention, the displaceable spline means comprises a substantially elongated C-shaped member. Furthermore, the screen enclosure apparatus additionally includes air venting means which are used to facilitate the passage of ambient air between at least a portion of the displaceable spline means and the interior portion of the channel means when the displaceable spline means is operably positioned within the channel means of the frame means. The air venting means serve to minimize contact of the displaceable spline means with corrosion products which may form in the internal portion of the channel means, and additionally serves to substantially minimize and preclude the initiation of corrosion which may occur within the interior portion of the channel means, and accordingly along the displaceable spline means itself. In this embodiment of the invention, the air venting means comprise one or more rib members which are operably and longitudinally positioned along at least that portion of the displaceable spline means operably juxtaposed along and within the interior portion of the channel means.

In a preferred embodiment of the invention, the screen enclosure apparatus further comprises identification means which are used to facilitate a visual determination of the predetermined amount of wind force pressure necessary to controllably release a portion of the displaceable spline means from within the channel means of the frame means. In one embodiment, the identification means actually comprise one or more coded protuberances, or rib-like members, which are operably attached to at least a portion of the displaceable spline means. In yet another embodiment, the identification means comprise coded control rate indicia and/or coloring which is operably applied to at least a portion of the displaceable spline means.

In yet another embodiment of the invention, the displaceable spline means varies in transverse cross sectional area along its longitudinal dimension. Such variance in cross section serves to reduce deformation of the displaceable spline means at the thicker transverse cross sectional areas of the spline means. Accordingly, this variance serves to alter the controlled release, and, in turn, the rate of release of said displaceable spline means along particular portions of the longitudinal dimension—to in turn, enable prompting of release at a particular position of the screen frame, such as at the floor or ceiling.

In the preferred embodiment of the invention also, the frame means of the apparatus is constructed of an extruded aluminum material. In addition, to help reduce the amount of corrosion, such as filiform corrosion which can occur to anodized, or painted aluminum, the frame means is preferably coated with a corrosion protection reagent.

Also in the preferred embodiment of the invention, the one or more screen sheet means are constructed of a polyvinylchloride coated fiberglass. In addition, the displaceable spline means is also constructed from a polyvinylchloride material, which may or may not include a filler material to control hardness, brittleness, rigidity and flexibility. Such "fillers" can include calcium carbonate, talc, mica or any one of several other mineral or carbonaceous materials.

DETAILED DESCRIPTION OF THE DRAWINGS

Figure 1:
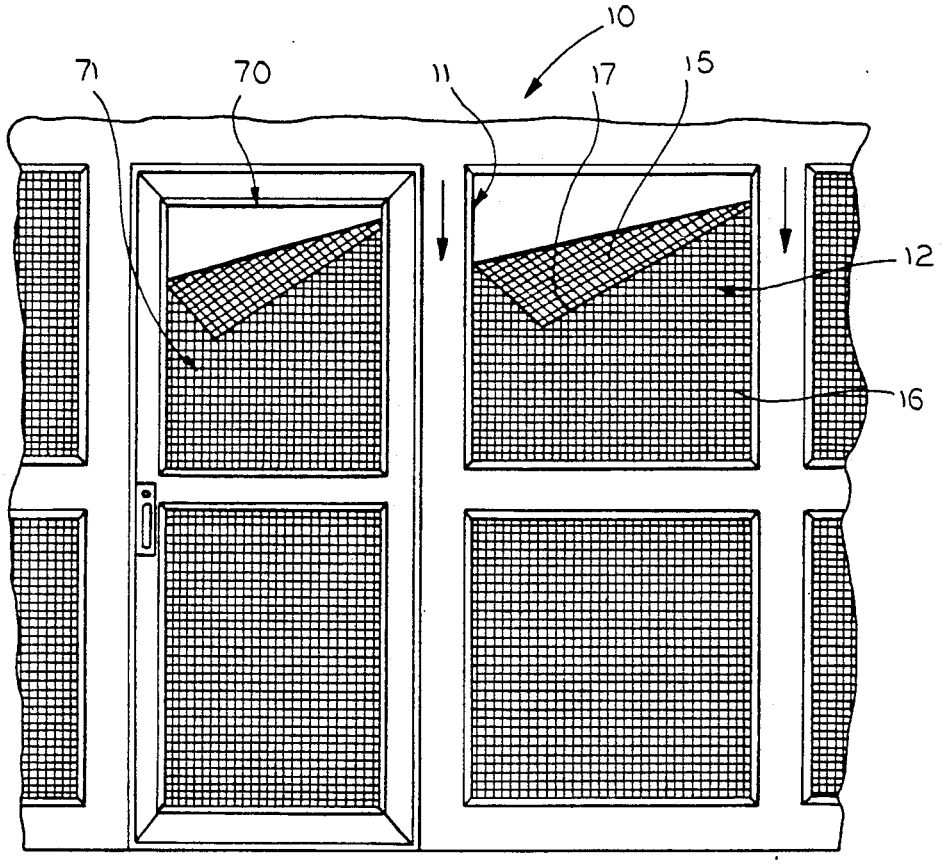
FIG. 1 of the drawings is an elevated rear view of the screen enclosure apparatus from the interior of a building structure showing, in particular, the controlled release of the top portion of the screen sheet means as a result of controlled spline release, to, in turn, enable high winds to pass through the space previously occupied by the released screen sheet, so as to reduce the pressure on the screen and frames, to preclude damage to both.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiment so illustrated.

Figure 2:
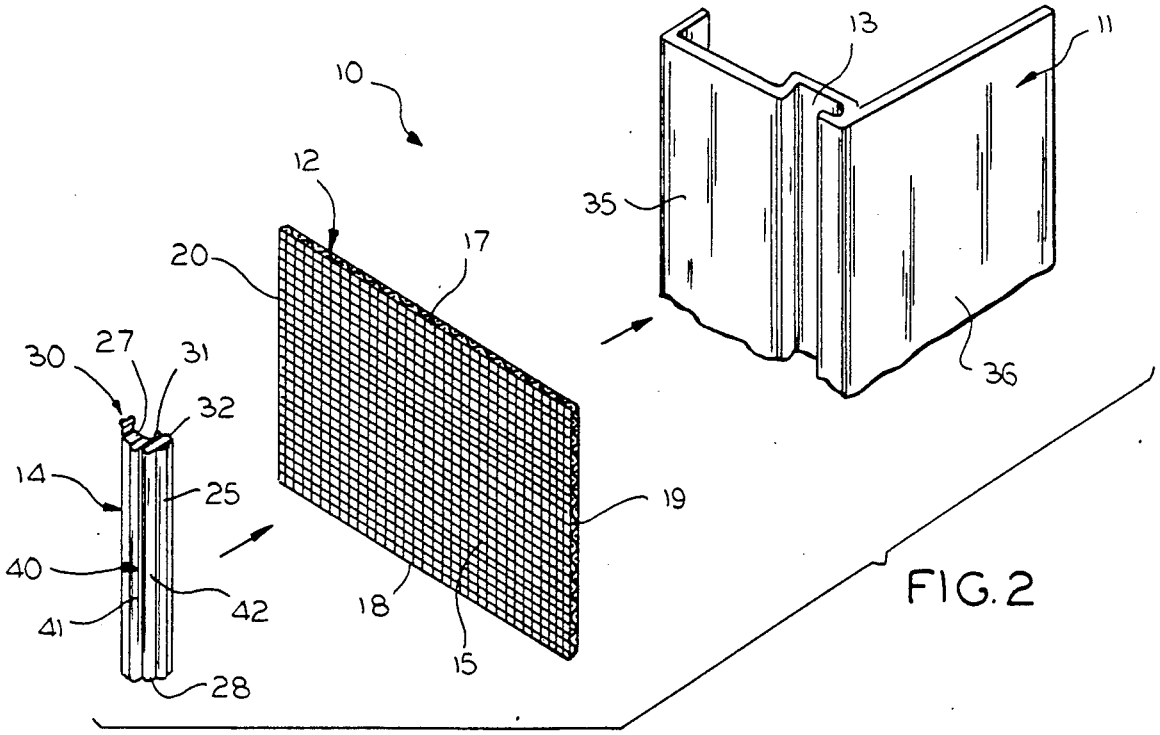
FIG. 2 of the drawings is an exploded perspective view of the screen enclosure apparatus showing, in particular, the displaceable spline means, the screen sheet means, a portion of the frame means, as well as the channel means of the frame means into which the screen means and spline means are releasably fitted.
Figure 6:
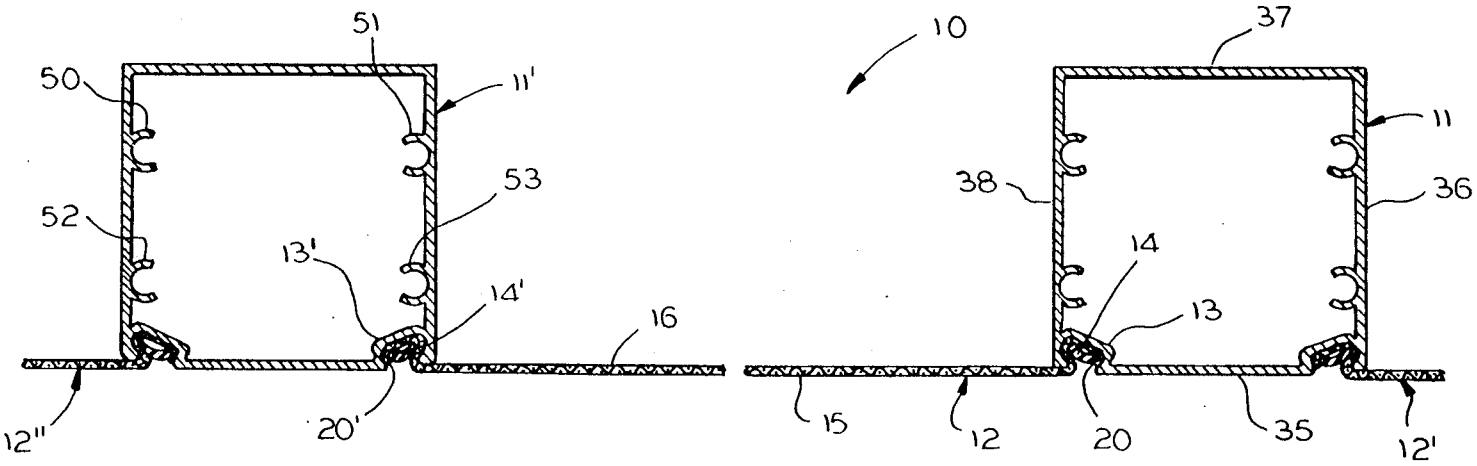
FIG. 6 of the drawings is a top cross sectional view of the screen enclosure apparatus in FIG. 5 showing, in particular, operable cooperation between the screen, spline and frame elements of the present screen enclosure apparatus, as well as revealing embodiments of frame means possessing two channel means for acceptance of portions of two separate screen sheets.

Screen enclosure apparatus 10 is shown in FIG. 1 and FIG. 2 as including frame means, such as frame means 11 and 70, screen sheet means, such as screen sheet means 12 and 71, and displaceable spline means 14. Frame means, such as frame means 11, includes front surface 35, outer side 36, back surface 37 and inner side 38, as shown in FIG. 6, and channel means 13, which is integrally formed within adjacent front surface 35 of frame means 11, which serves to releasably retain a portion of displaceable spline means 14, and, at least a portion of screen sheet means 12. Screen sheet means 12 includes front surface 15, back surface 16, top edge 17, bottom edge 18, first side edge 19 and second side edge 20. Displaceable spline means 14 is shown as having an outer surface 25 and an inner surface 26, as shown in FIG. 4A, with top edge 27, bottom edge 28, air venting means 30, and identification means 40 shown in FIG. 3. Identification means 40 are operably positioned on outer surface 25 of spline means 14, and, as shown, comprise a plurality of protuberances or ribs, such as ribs 41 and 42—although other means of identification, such as coded indicia, are also contemplated to inform a user of the "rating" or controlled release point for the spline. Preferably, air venting means 30 comprises a plurality of rib members, such as rib members 31 and 32 to form a ventilating air duct for juxtapositioning against the extruded aluminum frame channel.

Furthermore as depicted in FIG. 1, at least a portion of displaceable spline means 14, and in turn, at least a portion of screen sheet means 12, is intended to be controllably released from channel means 13 of frame means 11 upon exertion of a predetermined amount of wind pressure, which, if said release, or "popping out", were not to occur, could severely damage the screen sheet, and, in turn, the frame structures, such as frame 11, for the overall apparatus 10.

Inasmuch as such damaging wind pressures readily occur in areas typically prone to hurricane type conditions, testing for desirable controlled release of spline means 14, and, in turn, screen sheet means 12, were performed in a vacuum chamber to simulate such conditions. Although it is well recognized that a conventional spline is capable of withstanding wind pressures easily in excess of 25–30 psf, the stress caused by such pressures can have damaging effects on the screen sheet itself, and, in turn, on the actual frame member. After a series of tests within the vacuum chamber, in which a 7'-0" wide×8'- 0" high 14/10 fiberglass screen with PVC drip coating, having open areas not less then 60 percent, and in which the screen sheet was releasably secured within a 0.297" wide×0.150" channel of a 2"×2"×.0.37" aluminum frame, by various sizes of spline means 14, it was determined that such controlled release of spline means 14 could be achieved, between the range of 5 psf to 14 psf. A 0.297" wide channel, plus or minus 10% tolerance, is the current industry standard for such channels. The spline width preferably ranges from 0.25" to 0.34". The following results of such tests, in which uniform wind loads were applied perpendicularly to the screen sheet's front surface by means of a 4 millimeter visqueen, are as follows:

| SIZE OF SPLINE MEANS | P.S.F. AT WHICH ELASTOMERIC SPLINE MEANS POPPED-OUT |
|---|---|
| 0.325" wide × .045" thick | 9.0 |
| 0.275" wide × .045" thick | 5.0 |
| 0.290" wide × .045" thick | 7.0 |
| 0.315" wide × .045" thick | 14.0 |
| *0.275" wide × .045" thick | 10.0 |
| *0.275" wide × .045" thick | 12.0 |

*screen size altered to 8'-0" wide × 4'-0" high

When such predetermined wind force pressures are exerted upon the front surface 15 of screen sheet means 12, the corresponding spline means will controllably release from channel means 13, and accordingly, a portion of screen sheet means 12 will also release, in the direction of the vertical arrows shown in FIG. 1, so as to allow such high wind pressure to pass therethrough the structure—thereby precluding any potential for further damage to the screen and frames of apparatus 10. It is preferred that such "popping out" only occur at the top portion of spline means 14 and screen sheet means 12, although substantial, as well as total release, are also contemplated.

Figure 3:
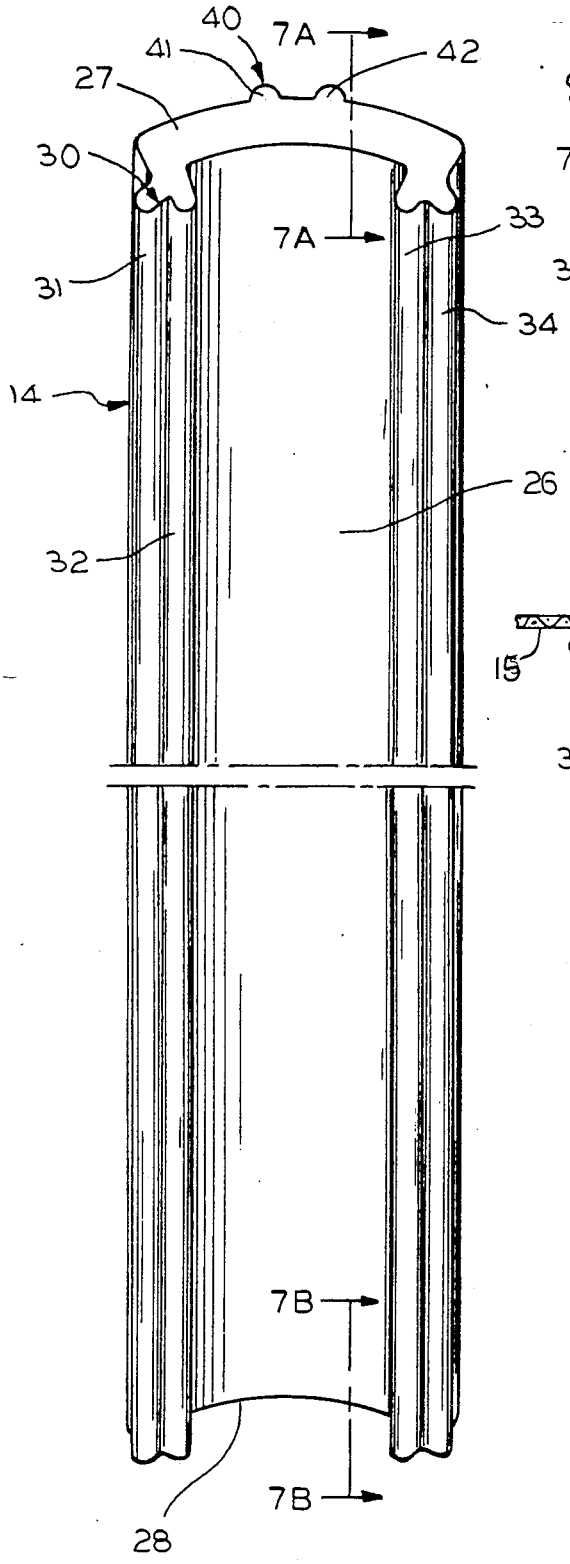
FIG. 3 of the drawings is a perspective view of the displaceable spline means showing, in particular, the rib members which make up the air venting means, as well as the protuberances which serve to identify the gauge of spline and, in turn, the predetermined rating for wind force necessary to controllably release the displaceable spline means from the channel of the frame means.
Figure 4A:
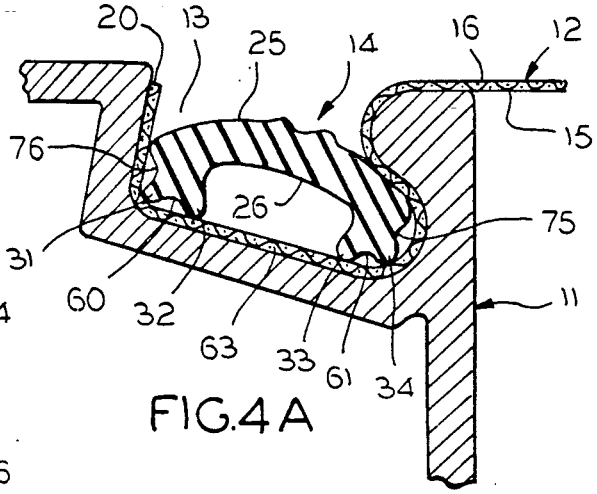
FIG. 4A of the drawings is a top plan cross sectional view of the screen enclosure apparatus showing, in particular, the positioning of the displaceable spline means in its releasable but secured position over a portion of the screen sheet means, within the internal area of the channel means.

Displaceable spline means 14 is shown in FIG. 3 as including top edge 27, bottom edge 28, inner surface 26, outer surface 25 (as shown in FIG. 4A), air venting means 30, and identification means 40. Venting means 30 are operably positioned primarily adjacent to inner surface 26 of displaceable spline means 14, and as shown in greater detail, in FIG. 4A, actually restrainably abut with a portion of front surface 15 of screen sheet means 12 within interior area of channel means 13 of frame 11. Preferably, air venting means 30 extend longitudinally between top edge 27 and bottom edge 28 of displaceable spline means 14, and comprise, a plurality of rib members, such as rib members 31 through 34. Each pair of rib members, 31 and 32, and, 33 and 34, form air gaps, such as air gaps 60 and 76, and 61 and 75 as shown in FIG. 4A. These gaps facilitate the circulation of air therethrough, and accordingly, over a substantial portion of channel means 11 when displaceable spline means 14, as well as a portion of screen sheet means 12, are operably positioned within channel means 13—to isolate contact of the spline and associated fouling with corrosion within the channel, as well as to preclude the initiation of filiform corrosion within the area of juxtaposition. The very flexibility of a displaceable spline additionally facilitates its insertion, with the screen, into the frame channel.

Identification means 40, also shown in FIG. 3, include one or more protuberances, or rib members, such as rib members 41 and 42. These rib members 41 and 42 are operably positioned on outer surface 25 of displaceable spline means 14, as shown in FIG. 4A, and serve to enable visual identification of the "rating" of the spline for a predetermined amount of wind pressure necessary to cause displacement of at least a portion of spline means 14, and accordingly, the release of a portion of screen sheet means 12, out from channel means 13 of frame means 11.

Figure 4B:
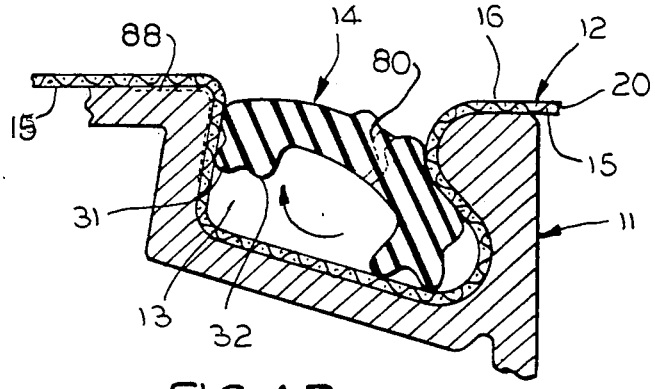
FIG. 4B of the drawings is a top plan cross sectional view of the screen enclosure apparatus in FIG. 4A showing, in particular, the initial displacement of the spline means within the channel means of the frame means, as a result of exertion of a particular threshold of wind force pressure exerted upon the top surface of the screen sheet means.

Spline means 14 is shown in FIG. 4A prior to displacement, and is shown in FIG. 4B during controlled displacement, which occurs in the direction of the arrow, upon exertion of a predetermined amount of wind force pressure on a front surface 15 of screen sheet means 12. In its normal, non-displaced position, spline means 14 is operably positioned within channel means 13 of frame means 11. Accordingly, in such a position, spline means 14 serves to secure screen sheet means 12 in a substantially taught, releasably secured position, as shown in FIG. 1, by simply having a portion of screen sheet means 12 wrapped under and around a portion of displaceable spline means 14. When properly positioned, screen sheet 12 will be sandwiched between channel means 13 and spline means 14, with at least end 20 of screen sheet means 12 extending past and around spline means 14. However, as shown in FIG. 4B, when said exertion of a predetermined wind force pressure is placed upon front surface 15 of screen sheet means 12, a resultant force occurs upon spline means 14 which causes displacement thereof, in the direction of the arrow, so as to cause the controlled release of at least a portion of spline means 14, and accordingly the release of a portion of screen sheet means 12, from channel means 13 of frame means 11. Such release thereby allows otherwise structural damaging high winds to pass freely over the area previously occupied by the released screen sheet means, as shown in FIG. 1. In the alternative embodiment of frangible spline, the spline will fracture at a pre-set pressure at fracture point 80, for example, to in turn, release the screen.

Also shown in FIG. 3 are air venting means 30 which comprise rib members 31 through 34, with FIG. 4A showing created gaps 76, 60, 61 and 75. Inasmuch as high winds are prevalent in coastal regions such as Florida and Texas, salt from the adjacent oceans mix in with the wind. Accordingly, this wind/salt mixture may regularly come into contact with channel means 13. As it is preferred that frame means 11 is constructed from extruded aluminum, which is typically anodized or painted, such a wind/salt mixture can result in filiform corrosion which could severely hinder the controlled release of spline means 14. Such air venting means 30, also shown in FIG. 3, facilitates circulation of air through gaps, such as gaps 60 and 61. Accordingly, substantial contact of spline means 14 with any potentially corrosive surface of channel means 13 is avoided. In addition, such air passages further help reduce the likelihood of such filiform corrosion from even forming. Further reduction of such corrosion is also contemplated inasmuch as aluminum frame 11 can be sprayed with a corrosion protective reagent, such as reagent 88 partially shown in phantom in FIG. 4B. One such reagent is NO-OX-ID treatment, a brand name for a treatment made by Sanchem, Inc. Also shown in FIG. 4A and FIG. 4B are front surface 15 and back surface 16 of screen sheet 12, and, outer surface 25 and inner surface 26 of spline means 14.

Figure 5:
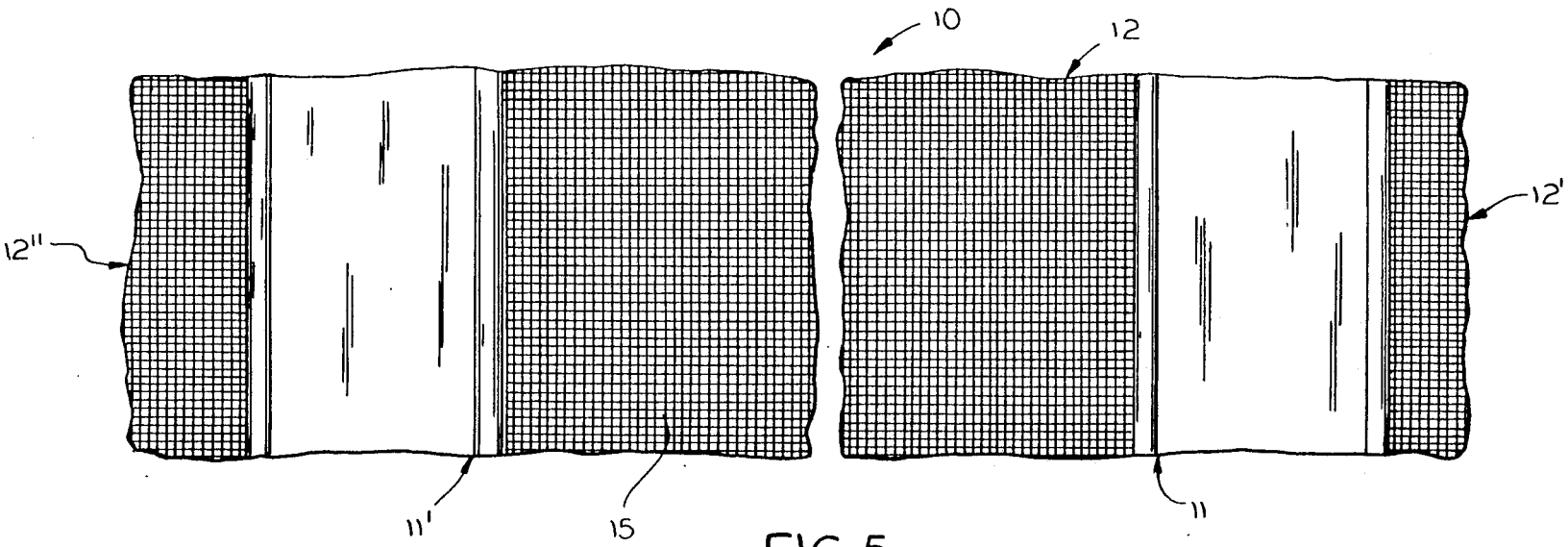
FIG. 5 of the drawings is a front elevational view of the screen enclosure apparatus, partially cut-away, showing in particular, the operable positioning of the screen sheet means within and between columns of frame means.

Screen enclosure apparatus 10, is shown in FIG. 5 and FIG. 6 in an assembled environment. As can be seen, frame means, such as frame means 11 and 11' are constructed with two channel means 13 and 13', respectively. Accordingly, each frame means, such as frame means 11 and 11', serve as a structural support for a portion of two individual screen sheets emanating in opposite directions—frame means 11 supporting screen sheet means 12 and 12', and frame means 11' supporting screen sheet means 12 and 12". When such screen sheets are operably positioned within their respective channel means, such as channel means 13 and 13', the majority of the front screen surfaces, such as front surface 15, of each screen sheet means, such as screen sheet means 12, 12' and 12", will be positioned in a substantially planer relationship with the front surfaces, such as front surface 35, of the frame means, such as frame means 11.

As can be seen in FIG. 6, as well as FIG. 1, a plurality of screen enclosure apparatuses 10, can, if desired, be used in cooperation with each other for providing multiple screened panels typically prevalent in porches or sun-rooms. Also shown in FIG. 6, are spline means, such as spline means 14 and 14', which releasably secure a portion of screen sheet means 12 near such screen sheet's respective ends 20 and 20', back surface 16 of screen sheet means 12, back surface 37, inner side 38, outer side 36 and front surface 35 of frame means 11, as well as structural members, such as structural members 50 through 53 of frame means, such as frame means 11'— which serve to provide or reinforce the necessary strength of the frame itself. Through utilization of the present invention, the structural strength of the extruded aluminum frames can be maintained at a reasonable cost-effective level— without undue reinforcement.

Figure 7A:
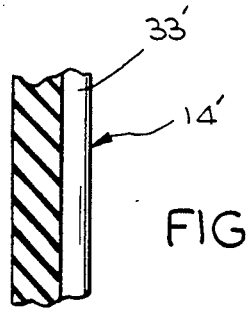
FIG. 7A of the drawings is a cross sectional view of an alternative displaceable spline means, taken along lines 7A—7A of FIG. 3, and looking in the direction of the arrows, showing in particular, a first narrow transverse cross sectional area near the top portion of a displaceable spline means.
Figure 7B:
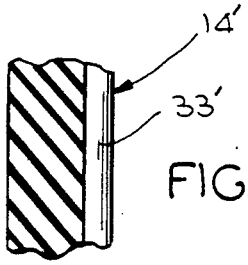
FIG. 7B of the drawings is a cross sectional view of the alternative screen enclosure apparatus taken along lines 7B—7B of FIG. 3, and looking in the direction of the arrows, showing in particular, a second substantially wider transverse cross sectional area near the bottom portion of the displaceable spline means, in an embodiment in which spline displacement will occur initially at the top portion shown in FIG. 7A.

The substantially narrow transverse cross sectional area near top 27 of spline 14', and substantially wider transverse cross sectional area near bottom 28 of this alternative displaceable spline 14', (as opposed to that shown in FIG. 3), are shown in FIGS. 7A and 7B, respectively. Preferably, such transverse cross sectional areas increase from top 27 to bottom 28, so as to facilitate controlled release of the upper, or narrower cross sectional area of spline means 14' first, upon a predetermined wind force pressure exerted upon the front surface of the screen sheet means. Accordingly, such controlled, limited, release reduces the amount of effort necessary to replace the released spline and screen back into its channel means—while providing enough release to avoid damage to the screen as well as the frame. Also shown in FIG. 7A and FIG. 7B is rib member 33' of the air venting means 30.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. A screen enclosure apparatus for use in screened windows, porches, doors and other screenable building structures, said apparatus being capable of controllably breaking away in the presence of high wind and/or hurricane conditions to, in turn, automatically reduce resultant wind pressures on the frames of said windows, porches, doors and other structures, said screen enclosure apparatus comprising:

one or more frame means, each having a front surface and a back surface opposite said front surface, two oppositely positioned sides, a longitudinal dimension and a transverse dimension;

one or more channel means integrally formed within said frame means, said one or more channel means spanning at least a portion of said longitudinal dimension of said frame means;

one or more screen sheet means capable of being operably attached within at least a portion of said frame means, said one or more screen sheet means having a front surface and a back surface opposite said front surface, a top edge, a bottom edge opposite said top edge, a first side edge and a second side edge opposite said first side edge, at least a portion of one or more of said first and second side edges, top edges and bottom edges of said one or more screen sheet means being operably disposed within an interior portion of a respective one of said one or more channel means of said one or more frame means; and displaceable spline means operably positioned within said channel means to operably bear against said screen sheet means portions within said one or more channel means for securing, and alternatively controllably releasing, at least a portion of said one or more screen sheet means upon displacement of said displaceable spline means as a function of pressure exerted against said screen sheet means by outside wind forces;

at least a portion of said displaceable spline means being capable of controllably releasing said portion of said screen sheet means upon exertion of a predetermined amount of said outside wind force pressure upon said front surface of said one or more screen sheet means, said controlled release of said portion of said displaceable spline means, and in turn, a portion of said one or more screen sheet means, from said channel means of said frame means permitting the passage of said outside wind force pressures more freely therethrough to, in turn, preclude wind force damage which could otherwise result to both said screen sheet means as well as said frame means structures.

2. The invention according to claim 1 in which said displaceable spline means is constructed from a substantially elastomeric material for facilitating said controlled deformation of at least a portion of said displaceable spline means upon said exertion of said outside wind force pressure upon said front surface of said one or more screen sheet means, to in turn, release said portion of said displaceable spline means, and accordingly, said portion of said one or more screen sheet means, from said channel means of said frame means.

3. The invention according to claim 2 in which said displaceable spline means is further re-insertable back into said channel means of said frame means after said controlled release has occurred, thereby enabling the re-use of said displaceable spline means for re-securing said portion of said screen sheet means.

4. The invention according to claim 1 in which said displaceable spline means comprises a substantially elongated C-shaped member.

5. The invention according to claim 1 in which the screen enclosure apparatus further includes air venting means for facilitating the passage of ambient air between at least a portion of said displaceable spline means and the interior portion of said channel means when said displaceable spline means is operably positioned within said channel means of said frame means, so as to avoid contact with corrosion products which may form in said interior portions of said channel means, as well as to substantially minimize and preclude the initiation of corrosion occurring alternatively within said interior portion of said channel means and along said displaceable spline means, which could otherwise occur.

6. The invention according to claim 5 in which said air venting means comprises one or more rib members operably and longitudinally attached along at least the portion of said displaceable spline means operably juxtaposed along and within the interior portion of said channel means.

7. The invention according to claim 1 in which the screen enclosure apparatus further comprises identification means for facilitating a visual determination of said predetermined amount of said wind force pressure necessary to controllably release said portion of said displaceable spline means from within said channel means of said frame means.

8. The invention according to claim 7 in which said identification means comprises one or more coded protuberances, operably attached to at least a portion of said displaceable spline means.

9. The invention according to claim 8 in which said identification means comprises coded control rate indicia operably applied to at least a portion of said displaceable spline means.

10. The invention according to claim 1 in which said frame means is constructed of an extruded aluminum material.

11. The invention according to claim 10 in which said extruded aluminum material is coated with a corrosion protection reagent.

12. The invention according to claim 1 in which said one or more screen sheet means are constructed of polyvinylchloride coated fiberglass screen material.

13. The invention according to claim 1 in which said displaceable spline means is constructed of a polyvinyl-chloride material.

14. A screen enclosure apparatus for use in screened windows, porches, doors and other screenable building structures, said apparatus being capable of controllably breaking away in the presence of high wind and/or hurricane conditions to, in turn, automatically reduce resultant wind pressures on the frames of said windows, porches, doors and other structures, said screen enclosure apparatus comprising:

one or more frame means, each having a front surface and a back surface opposite said front surface, two oppositely positioned sides, a longitudinal dimension and a transverse dimension;

one or more channel means integrally formed within said frame means, said one or more channel means spanning at least a portion of said longitudinal dimension of said frame means;

one or more screen sheet means capable of being operably attached within at least a portion of said frame means, said one or more screen sheet means having a front surface and a back surface opposite said front surface, a top edge, a bottom edge opposite said top edge, a first side edge and a second side edge opposite said first side edge, at least a portion of one or more of said first and second side edges, top edges and bottom edges of said one or more screen sheet means being operably disposed within an interior portion of a respective one of said one or more channel means of said one or more frame means;

displaceable spline means for securing, and alternatively controllably releasing, at least a portion of said one or more screen sheet means operably positioned within said channel means of said frame means, as a function of pressure exerted against said screen sheet means by outside wind forces;

at least a portion of said displaceable spline means being capable of controllably releasing said portion of said screen sheet means upon exertion of a predetermined amount of said outside wind force pressure upon said front surface of said one or more screen sheet means, said controlled release of said portion of said displaceable spline means, and in turn, a portion of said one or more screen sheet means, from said channel means of said frame means permitting the passage of said outside wind force pressures more freely therethrough to, in turn, preclude wind force damage which could otherwise result to both said screen sheet means as well as said frame means structures, said displaceable spline means being constructed from a substantially non-elastomeric frangible material for facilitating the controlled frangible breakage of at least a portion of said displaceable spline means upon said exertion of said outside wind force pressure upon said front surface of said one or more screen sheet means, to in turn, release said portion of said displaceable spline means otherwise securing said screen sheet means, and in turn, release said portion of said one or more screen sheet means, from within said channel means of said frame means.

15. A screen enclosure apparatus for use in screened windows, porches, doors and other screenable building structures, said apparatus being capable of controllably breaking away in the presence of high wind and/or hurricane conditions to, in turn, automatically reduce resultant wind pressures on the frames of said windows, porches, doors and other structures, said screen enclosure apparatus comprising:

one or more frame means, each having a front surface and a back surface opposite said front surface, tow oppositely positioned sides, a longitudinal dimension and a transverse dimension;

one or more channel means integrally formed within said frame means, said one or more channel means spanning at least a portion of said longitudinal dimension of said frame means;

one or more screen sheet means capable of being operably attached within at least a portion of said frame means, said one or more screen sheet means having a front surface and a back surface opposite said front surface, a top edge, a bottom edge opposite said top edge, a first side edge and a second side edge opposite said first side edge, at least a portion of one or more of said first and second side edges, top edges and bottom edges of said one or more screen sheet means being operably disposed within an interior portion of a respective one of said one or more channel means of said one or more frame means;

displaceable spline means for securing, and alternatively controllably releasing, at least a portion of said one or more screen sheet means operably positioned within said channel means of said frame means, as a function of pressure exerted against said screen sheet means by outside wind forces;

at least a portion of said displaceable spline means being capable of controllably releasing said portion of said screen sheet means upon exertion of a predetermined amount of said outside wind force pressure upon said front surface of said one or more screen sheet means, said controlled release of said portion of said displaceable spline means, and in turn, a portion of said one or more screen sheet means, from said channel means of said frame means permitting the passage of said outside wind force pressures more freely therethrough to, in turn, preclude wind force damage which could otherwise result to both said screen sheet means as well as said frame means structures, said displaceable spline means varying in transverse cross-section along said longitudinal dimension so as to reduce said deformation of said displaceable spline means at thicker transverse cross-sectional areas, to, in turn, alter said controlled release and, in turn, the rate and initial positions of release of said displaceable spline means along said longitudinal dimension.

* * * * *

UNITED STATES PATENT AND TRADEMARK OFFICE

CERTIFICATE OF CORRECTION

PATENT NO. : 5,046,546

DATED : September 10, 1991

INVENTOR(S) : Joseph C. Benedyk and Ronald J. Basar

It is certified that error appears in the above-identified patent and that said Letters Patent is hereby corrected as shown below:

| | |
|---|---|
| Column 12, Line 13 | "front surface, tow" should read instead -- front surface, two -- |

Signed and Sealed this

Tenth Day of August, 1993

*Attest:*

*Attesting Officer*

Michael K. Kirk

MICHAEL K. KIRK

*Acting Commissioner of Patents and Trademarks*